US010775720B2

(12) United States Patent
Suzuki

(10) Patent No.: US 10,775,720 B2
(45) Date of Patent: Sep. 15, 2020

(54) IMAGE FORMING APPARATUS HAVING A COOLING PORTION AND A CONTROLLER CONFIGURED TO OPERATE THE COOLING PORTION IN ONE MODE OF A PLURALITY OF MODES

(71) Applicant: CANON KABUSHIKI KAISHA, Tokyo (JP)

(72) Inventor: Koji Suzuki, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/363,251

(22) Filed: Mar. 25, 2019

(65) Prior Publication Data

US 2019/0294084 A1 Sep. 26, 2019

(30) Foreign Application Priority Data

Mar. 26, 2018 (JP) ..... 2018-058323

(51) Int. Cl.
*G03G 15/20* (2006.01)
*G03G 15/00* (2006.01)
*G03G 21/20* (2006.01)

(52) U.S. Cl.
CPC ..... *G03G 15/2017* (2013.01); *G03G 15/5025* (2013.01); *G03G 21/206* (2013.01)

(58) Field of Classification Search
CPC .. G03G 21/206; G03G 21/20; G03G 15/2017; G03G 15/2039; G03G 2221/1645
See application file for complete search history.

(56) References Cited

U.S. PATENT DOCUMENTS

2007/0053731 A1* 3/2007 Mori ..... G03G 15/2021 399/341
2010/0054771 A1* 3/2010 Miyahara ..... G03G 15/20 399/44
2015/0241841 A1* 8/2015 Sakurai ..... G03G 21/206 399/92
2016/0091860 A1* 3/2016 Kawai ..... G03G 21/206 399/44

FOREIGN PATENT DOCUMENTS

JP 2006-091627 A 4/2006

* cited by examiner

*Primary Examiner* — Walter L Lindsay, Jr.
*Assistant Examiner* — Jessica L Eley
(74) *Attorney, Agent, or Firm* — Venable LLP

(57) ABSTRACT

An image forming apparatus including an image forming portion, a heating portion, a discharging portion, a cooling portion, and a controller. A toner amount per predetermined sheet area of a toner image formed on a sheet is a toner image density. A first toner image does not have regions where the toner image density is a predetermined first density or more, and when the first toner image is formed on the sheet, the controller executes an operation in a first mode. A second toner image includes the region, and when the second toner image is formed on the sheet, the controller executes an operation in a second mode higher in cooling power than the first mode irrespective of a toner amount of the second toner image over entirety of the sheet.

10 Claims, 8 Drawing Sheets

IMAGE FORMING APPARATUS HAVING A COOLING PORTION AND A CONTROLLER CONFIGURED TO OPERATE THE COOLING PORTION IN ONE MODE OF A PLURALITY OF MODES

CROSS-REFERENCE TO RELATED APPLICATIONS

This application claims the benefit of Japanese Patent Application No. 2018-058323 filed on Mar. 26, 2018, which is hereby incorporated by reference herein in its entirety.

FIELD OF THE INVENTION AND RELATED ART

The present invention relates to an image forming apparatus for forming an image on a sheet.

Image forming apparatuses of an electrophotographic include an image forming apparatus having a fixing device of a heat fixing type. In such fixing devices, a toner image formed on a photosensitive member is transferred onto the sheet, which is a recording medium, and thereafter, is heated, fixing the image on the sheet. Toner melted by heating of the toner image is solidified by controlled cooling with outside air or the like. When the sheet passed through the fixing device is stacked on a discharge tray or the like in a situation such that the sheet is not sufficiently cooled, there is a possibility that the toner is melted again, and then the sheets adhere to each other, depositing the toner on another sheet. Therefore, in many image forming apparatuses, a cooling fan for cooling the sheet by blowing air on the sheet which has passed through the fixing device is provided.

Japanese Laid-Open Patent Application (JP-A) 2006-91627 discloses that cooling power of a cooling fan is controlled on the basis of a print ratio, i.e., a ratio of a toner deposition region to an effective printing region. According to JP-A 2006-91627, each of two cooling fans can be rotated at high and low speeds and the rotation can be stopped. Further, the drive of the cooling fan is controlled so that an air blowing amount (rate) is larger with a higher print ratio.

In the construction disclosed in JP-A 2006-91627, the print ratio is calculated from image data for one page, and therefore, the air blowing amount of the cooling fan is controlled depending on the toner deposition amount over entirety of the sheet. According to a study by the inventor of the present invention, however, even in the case when the toner deposition amount over entirety of the sheet is the same, it turned out that there is a difference in ease of occurrence of re-melting of the toner depending on whether or not there is a portion when an image density is locally high in an output image. Accordingly, in the construction disclosed in JP-A 2006-91627, there is a possibility that the air blowing amount is insufficient compared with an air blowing amount necessary to avoid re-melting. Thus, re-melting occurs, or conversely, the air blowing amount is excessive, resulting in excessively high noise levels and excessively large power consumption.

SUMMARY OF THE INVENTION

A principal object of the present invention is to provide an image forming apparatus capable of efficiently cooling a sheet.

According to an aspect of the present invention, there is provided an image forming apparatus including an image forming portion, a heating portion, a discharging portion, a cooling portion, and a controller. The image forming portion is configured to form a toner image on a sheet. The heating portion is configured to heat the toner image formed by the image forming portion. The discharging portion is configured to discharge the sheet passed through the heating portion. The cooling portion is configured to cool the sheet heated by the heating portion. The controller is capable of causing the cooling portion to operate in any one of a plurality of modes. The plurality of modes includes a first mode and a second mode higher in cooling power than the first mode. A toner amount per predetermined sheet area of the toner image formed on the sheet by the image forming portion is a toner image density. When a first toner image, having a region where the toner image density is a predetermined first density or more is absent, is formed on the sheet, the controller executes an operation in the first mode, and when a second toner image, in which the region is present, is formed on the sheet, the controller executes an operation in the second mode irrespective of a toner amount of the second toner image over entirety of the sheet.

Further features of the present invention will become apparent from the following description of exemplary embodiments with reference to the attached drawings.

Figure 8:
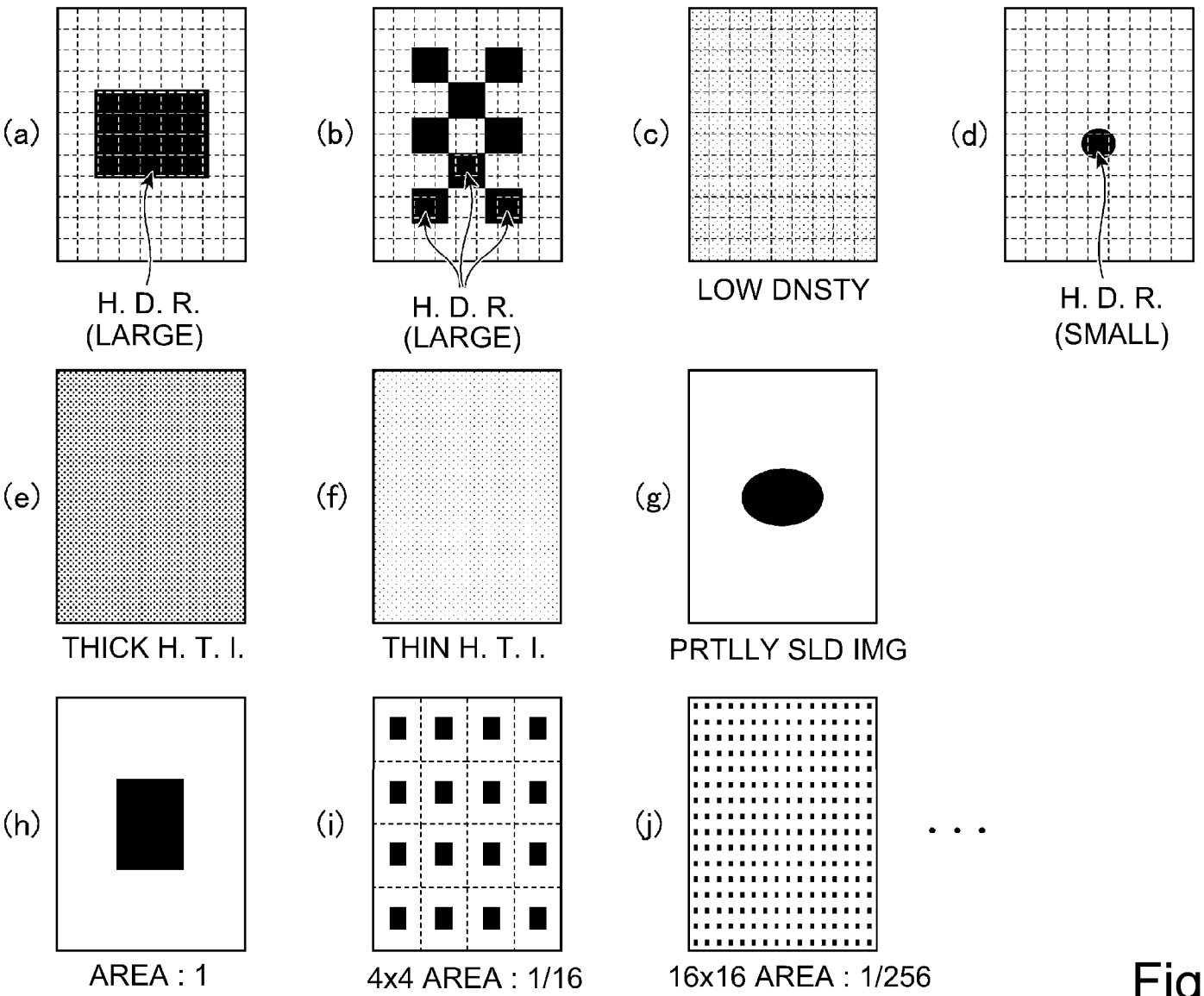

Parts (a) to (j) of FIG. 8 are image views showing image examples for illustrating operations of the cooling fans in the respective embodiments.

DESCRIPTION OF EMBODIMENTS

In the following, an image forming apparatus according to the present invention will be described with reference to the drawings. The image forming apparatus includes a printer, a copying machine, a facsimile machine, and a multi-function machine. The image forming apparatus forms an image on a sheet used as a recording medium on the basis of image information inputted from an external PC (personal computer) or image information read from an original. The sheet used as the recording medium includes: papers, such as plain paper and thick paper; plastic films, such as a sheet for an overhead projector; sheets having particular shapes, such as an envelope and index paper; and cloth.

Figure 1:
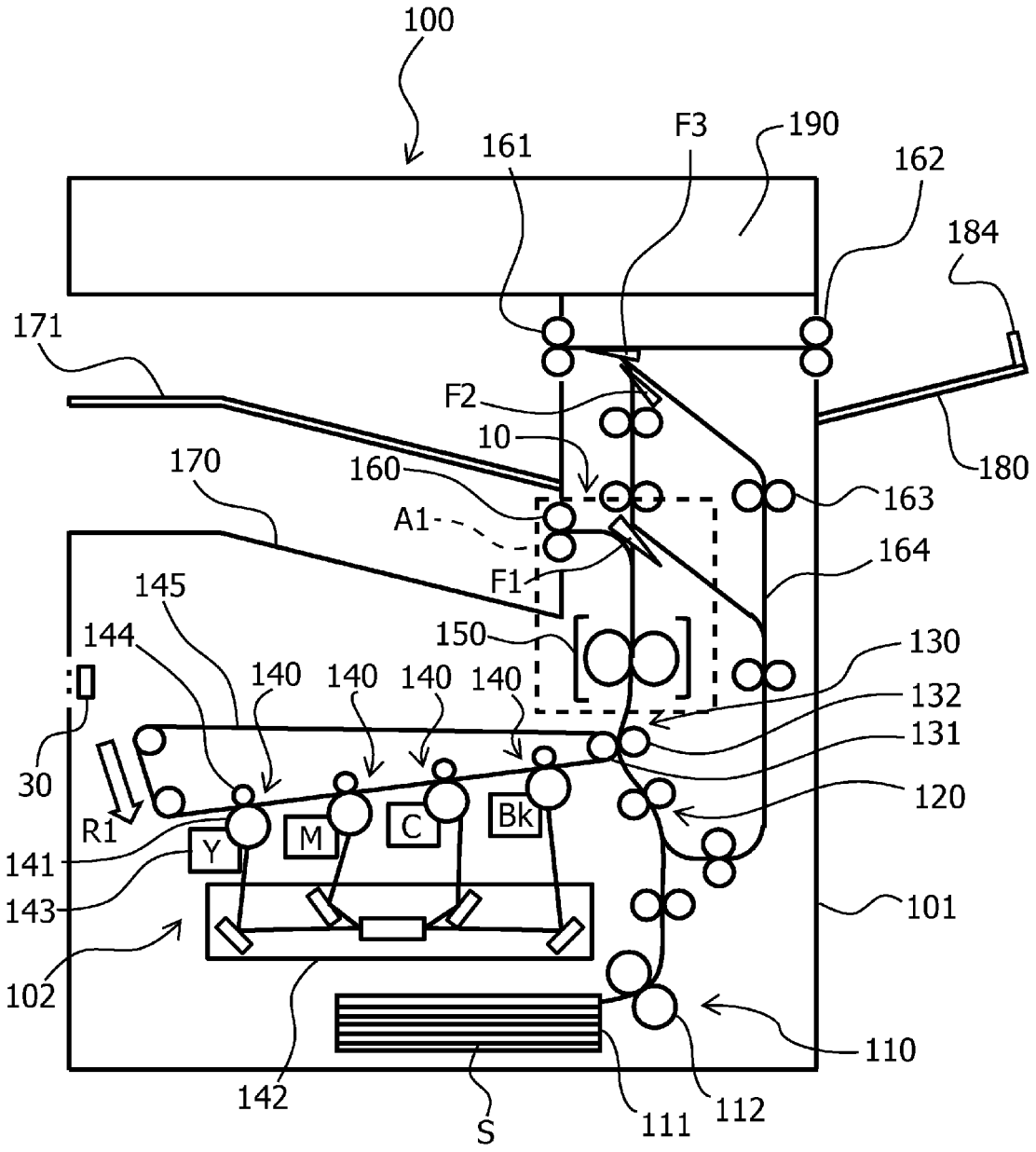
FIG. 1 is a schematic view of an image forming apparatus according to the present invention.

FIG. 1 is a schematic view showing a sectional structure of an image forming apparatus 100 according to the present invention. In an apparatus main assembly 101 of the image forming apparatus 100, an image forming portion 102 is an electrophotographic unit of a so-called intermediary transfer tandem type in which four image forming units 140 for forming toner images of four colors of yellow (Y), magenta (M), cyan (C) and black (Bk) are provided along an intermediary transfer belt 145.

The image forming portion 102 includes the image forming units 140, the intermediary transfer belt 145, an inner secondary transfer roller 131 and an outer secondary transfer roller 132. The intermediary transfer belt 145 and the outer secondary transfer roller 132 are an image bearing member and a transfer means, respectively, in this embodiment.

An image forming process by the image forming portion 102 will be described. Each of the image forming units 140 includes a photosensitive drum 141, as a photosensitive member, a developing device 143, and a primary transfer device 144. Further, the photosensitive drum 141 of each of the image forming units 140 is configured to be irradiated with laser light emitted from an exposure device 142 provided at a lower portion of the apparatus main assembly 101. When the image forming process is started, the photosensitive drum 141 is uniformly electrically charged by a charging means, such as a charging roller, and the charged photosensitive drum 141 is then irradiated with the laser light emitted from the exposure device 142, so that the photosensitive drum 141 is exposed to the laser light. At this time, the exposure device 142 has already received a signal (video signal) corresponding to data of an image to be printed and emits laser light modulated based on the video signal. The photosensitive drum 141 is irradiated with the laser light through an optical system including a polygon mirror. As a result, an electrostatic latent image corresponding to the image data is formed on a surface of the photosensitive drum 141.

The developing device 143 supplies toner to the electrostatic latent image formed on the photosensitive drum 141, so that the latent image is visualized (developed) into a toner image. Thereafter, a predetermined pressing force and a predetermined electrostatic load bias are applied by the primary transfer device 144, so that the toner image is transferred from the photosensitive drum 141 onto the intermediary transfer belt 145 (a primary transfer).

The intermediary transfer belt 145 is rotationally driven in an arrow R1 direction of FIG. 1. A toner image forming operation described above is performed in parallel in the respective image forming units 140. Further, primary transfer of the toner image onto the intermediary transfer belt 145 is carried out so that the toner image formed by the image forming unit 140 on a downstream side is superposed on the toner image formed by the image forming unit 140 on an upstream side. As a result, a full-color toner image is formed on the intermediary transfer belt 145. The full-color toner image is carried by the intermediary transfer belt 145 and thus is fed toward a secondary transfer portion 130.

The secondary transfer portion 130 is a nip formed by the inner secondary transfer roller 131 and the outer secondary transfer roller 132, which oppose each other. The toner image is transferred from the intermediary transfer belt 145 onto a sheet S while the sheet S is nipped and fed. That is, a predetermined pressing force and an electrostatic load bias are applied by the outer secondary transfer roller 132, so that the toner image is transferred from the intermediary transfer belt 145 onto the sheet S.

Thereafter, the sheet S is fed toward a fixing device 150 as a heating means for heating the toner image. The fixing device 150 applies heat and pressure to the toner image while nipping and feeding the sheet S by a rotatable member pair such as a roller pair or a belt pair. As a result, the toner is melted and thereafter is solidified, so that the toner, and thus the image, is fixed on the sheet S. Incidentally, details of the fixing device 150 will be described later using FIG. 2.

In parallel to the above-described image forming process, a feeding process of the sheet S is executed in the following manner. First, the sheet used as the recording medium is supplied to the image forming portion 102 by a sheet feeding device 110. The sheet feeding device 110 includes a cassette 111 including a lift-up device moving upward and downward in a state in which the sheets S are stacked and includes a feeding unit 112 as a feeding means for feeding the sheets S one by one from the cassette 111. The sheet S fed by the feeding unit 112 is fed toward the oblique movement correcting device 120 through a feeding path. The oblique movement correcting device 120 corrects oblique movement of the sheet S and then feeds the sheet S toward the secondary transfer portion 130 at timing determined in synchronism with the toner image forming operation by the image forming portion 102.

The sheet S, on which the toner image is transferred at the secondary transfer portion 130, is then fixed as a fixed image by the fixing device 150 and then reaches a branch portion where a first switching flap F1 is provided. The first switching flap F1 guides the sheet S to either one of a sheet feeding path toward a first discharging roller pair 160 and a sheet discharging path toward a second discharging roller pair 161. A sheet S that reaches the first discharging roller pair 160 is discharged by the first discharging roller pair 160 onto a first discharge tray 170 provided at an upper portion of the apparatus main assembly 101.

A sheet S that reaches the second discharging roller pair 161 is discharged by the second discharging roller pair 161 onto a second discharge tray 171 provided over the first discharge tray 170 or is reversed and fed by a reversing operation of the second discharging roller pair 161. In the case when the sheet S is discharged onto a third discharge tray 180, the reversed sheet S is guided to a third discharging roller pair 162 by a third switching flap F3 and is discharged by the third discharging roller pair 162. In the case when double-side printing is carried out, the reversed sheet S is guided to a double-side printing feeding path 164 by a second switching flap F2 and the third switching flap F3 and is fed again to the oblique movement correcting device 120 by a double-side printing roller pair 163. A sheet S that reaches the oblique movement correcting device 120 is discharged onto either one of the discharge trays 170, 171 and 180 after an image is formed on a second surface in in a manner similar to that discussed above for forming the image on a first surface. Each of the first to third discharging roller pairs 160, 161 and 162 is an example of a discharging portion for discharging the sheet S.

Incidentally, an image reading apparatus 190 is mounted on the apparatus main assembly 101. The image reading apparatus 190 includes an original supporting platen on which a sheet, which is an original, is to be set and includes a scanning unit by which the sheet set on the original supporting platen is to be optically scanned, and converts image information of the original into an electronic signal. The thus acquired image data is transmitted to a controller of the apparatus main assembly 101 and is converted into a video signal in the case of a copying operation, and then is sent to the exposure device 142.

Figure 2:
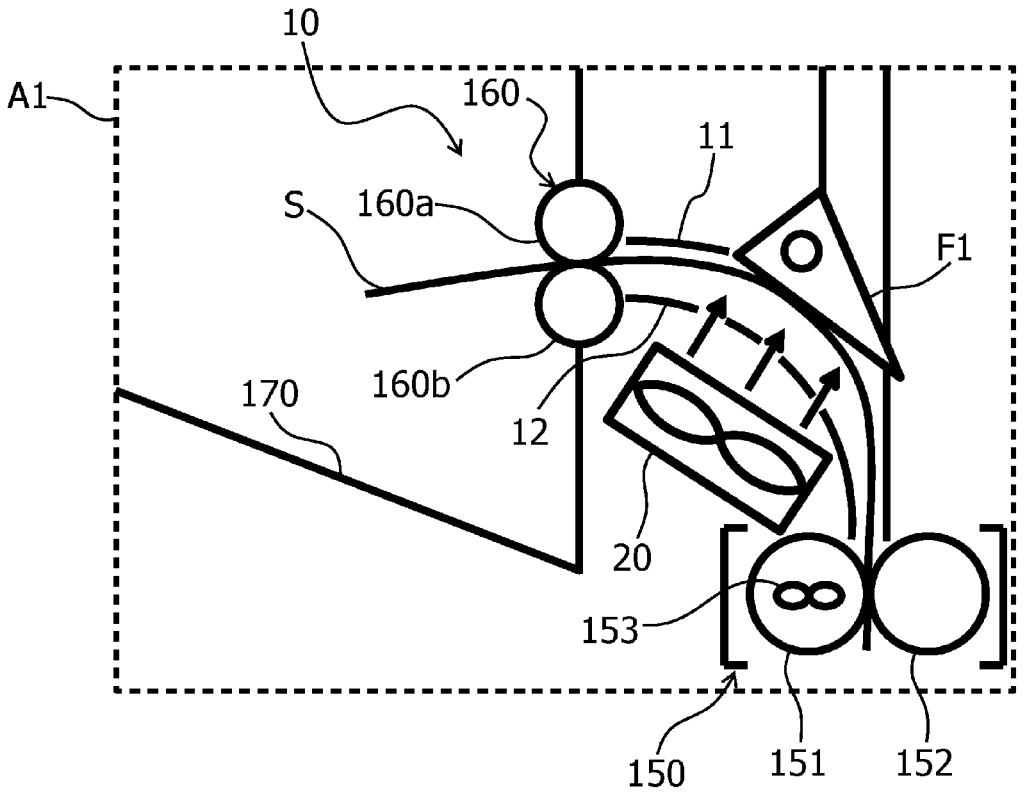
FIG. 2 is a schematic view of a sheet discharging portion.

Here, a sheet discharging portion 10 provided in the image forming apparatus 100 will be described. FIG. 2 is an enlarged view of a portion of the image forming apparatus in the neighborhood of the fixing device 150 and the first discharging roller pair 160 (a portion A1 identified by broken lines in FIG. 1).

The sheet discharging portion 10 discharges the sheet S passed through the fixing device 150 onto the first discharge tray 170 by the first discharging roller pair 160 as the discharging portion. The first discharging roller pair 160 is constituted by a driving roller 160*a* rotationally driven by a motor and a follower roller 160*b* rotated by the driving roller 160*a*. The sheet S fed from the fixing device 150 is guided to the first discharging roller pair 160 by an upper-side feeding guide 11 extending from the first switching flap F1 toward the first discharging roller pair 160. Further, a lower-side feeding guide 12 is provided opposed to the upper-side feeding guide 11.

The fixing device 150 includes a fixing roller 151 and an opposite roller 152 which are used as a rotatable fixing member pair for nipping and feeding the sheet S and includes a heat source 153 such as a halogen lamp or an induction heating (IH) unit. The opposite roller 152 is press-contacted to the fixing roller 151 at a predetermined pressure, so that pressure and heat are applied to the sheet S when the sheet S passes through a nip (fixing nip) between the fixing roller 151 and the opposite roller 152. Incidentally, a construction in which one or both of the fixing roller 151 and the opposite roller 152 are replaced with belt members may also be employed as the rotatable fixing member pair.

Between the fixing device 150 and the first discharging roller pair 160, a cooling fan 20, as a cooling portion for cooling the toner image heated by the fixing device 150, is provided. The lower-side feeding guide 12 is provided with holes through which air passes, and the cooling fan 20 blows air onto the sheet S through these holes.

Figure 3:
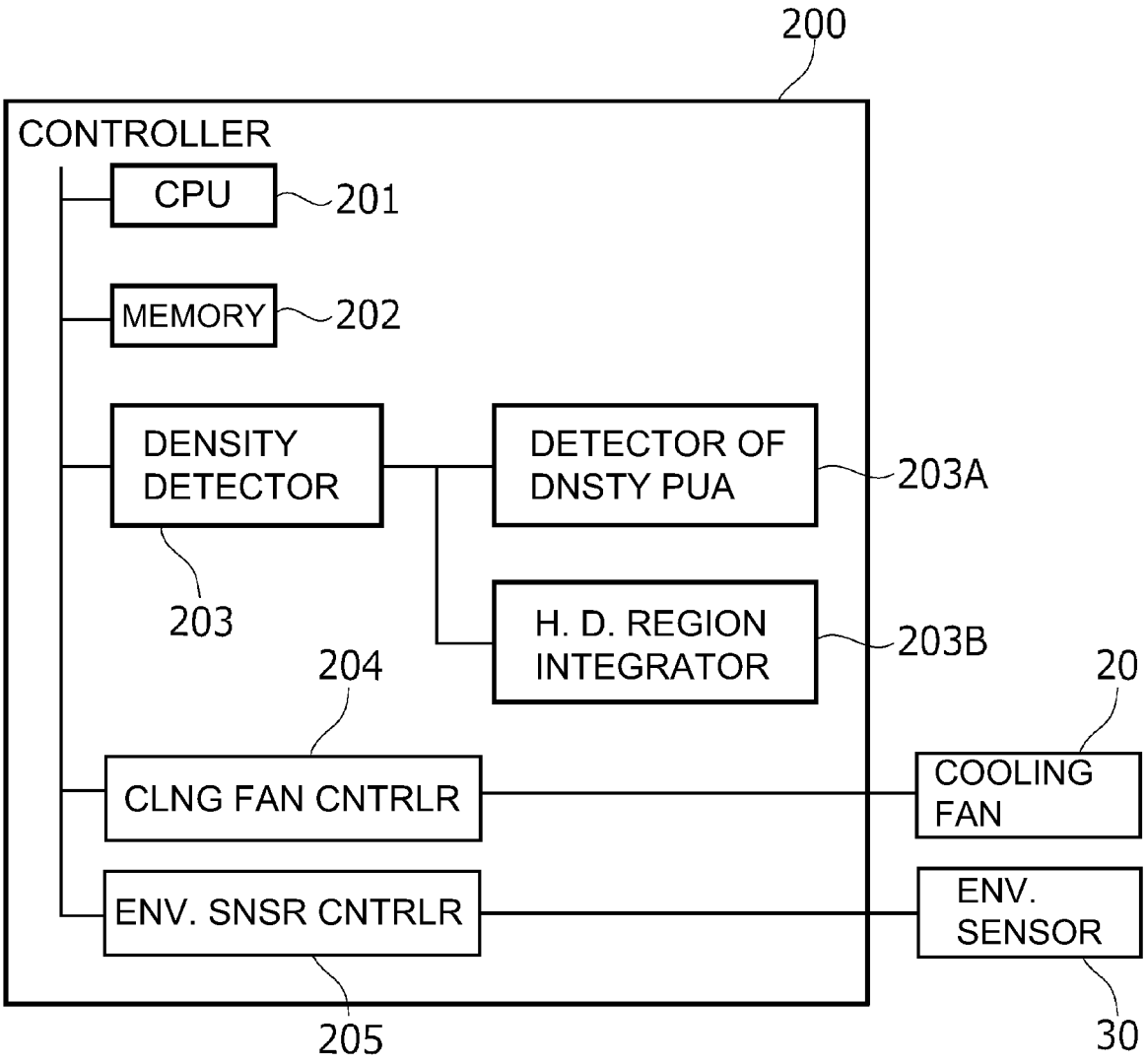
FIG. 3 is a block diagram showing a a construction for controlling a cooling fan in the sheet discharging portion.

Next, control of the cooling fan 20 will be described using a block diagram of FIG. 3. A controller 200, which is a control portion in this embodiment, includes functional portions such as a CPU (central processing unit) 201, a memory 202, a toner image density detecting portion 203, a cooling fan controller 204, and an environment sensor controller 205. The CPU 201 is capable of executing a predetermined control program and realizes various processes performed by the image forming apparatus 100. For example, the CPU 201 not only executes the image forming process and the feeding process for the sheet S, which are described above, but also controls the operation of the cooling fan 20. The memory 202 is, for example, a RAM (random access memory) or a ROM (read only memory) and stores various programs and various data in predetermined storing regions.

The toner image density detecting portion 203 is a means for acquiring information on a local density of the toner image formed on the sheet S. In this embodiment, the toner image density detecting portion 203 calculates the toner image density from the image data and includes a unit area detecting portion 203A and a high-density region integrating portion 203B. The unit area detecting portion 203A calculates a toner amount per unit area (for example per 1 inch×1 inch) of the image printed on the sheet S. In other words, the unit area detecting portion 203A calculates an amount of the toner deposited in a region having a predetermined area set in advance. The high-density region integrating portion 203B integrates, from a detection result of the unit area detecting portion 203A, areas of regions each having a value not less than a threshold set in advance.

The cooling fan controller 204 controls the presence or absence of air blowing and an air blowing amount of the cooling fan 20. Control of the air blowing amount specifically refers to a change in rotational speed of the cooling fan 20 and a change in the number of fans driven among a plurality of fans. The environment sensor controller 205 receives a detection value of an environment sensor 30 (FIG. 1) for measuring an ambient temperature (environmental temperature) in the neighborhood of a portion where the image forming apparatus 100 is installed.

Here, information on a local toner image density acquired by the toner image density detecting portion 203 can be acquired from the image data used when the image forming unit 140 forms the toner image. For example, an entirety of a region where the image forming portion 102 is capable of forming the toner image (hereafter referred to as an effective printing region) is divided into a plurality of unit area regions (hereafter referred to as unit regions) in advance. In this case, it is possible to acquire a toner image density in each unit area from the video signal transmitted from the controller 200 toward the exposure device 142. For example, in the case when a toner deposition amount for each color at each pixel is controllable at four levels, the number of gradation levels at each pixel is 256, and a toner amount at an associated pixel is determined from the number of gradation levels for the color designated by the video signal. Accordingly, the toner amounts at all the pixels in the region are integrated, so that with respect to this unit region, the toner image density per unit area can be acquired.

Further, the toner image density may also be acquired from image data in the form, other than the video signal, processed by the controller 200. For example, image data described by a page description language and sent from an external device to the image forming apparatus 100 is changed to intermediary data by an interpreter. This intermediary data is converted into image data of a raster form by a raster image processor and is used for forming a video signal. From these intermediary data and image data, a numerical value corresponding to the toner image density per unit area may also be calculated.

Incidentally, the information on the local toner image density may also be information representing an area of a latent image formed by the exposure device 142 or information representing an amount of use of the toner consumed by development of the latent image. Further, in place of a method of estimating the toner image density from the image data, the density of the toner image carried on the photosensitive drum or the intermediary transfer belt may also be measured using an optical sensor. That is, the toner image density detecting portion 203 may only be required to acquire, as the information on the toner image density, the toner deposition amount per unit area of the toner image formed by the image forming portion 102 or a numerical value (for example an OD value in the optical sensor) corresponding to the toner deposition amount.

Incidentally, conventionally, a method of adjusting the air blowing amount of the cooling fan 20 on the basis of the toner deposition amount over an entirety of the sheet has been known. As a result, the air blowing amount is increased in the case when a total amount of the toner constituting a printed image, so that a degree of adhesion of the sheets to each other due to re-melting of the toner on the discharged sheets and a degree of transfer of the toner image from a sheet onto an adjacent sheet are reduced. Further, in the case when the total amount of the toner constituting the printed image is small, the air blowing amount is decreased, so that reduction in noise and reduction in electric power consumption are realized.

According to a study by the inventor, however, it turned out that ease of an occurrence of the re-melting of the toner is not always determined by only the total amount of the toner constituting the printed image. Instead, even in the case when the total amount of the toner is the same, both the case when the re-melting is liable to occur and the case when the re-melting does not readily occur exist. The re-melting of the toner tends to occur at a portion of the printed image when the toner image density is high. For this reason, in the case when a region in which the toner image density is high locally exists in the effective printing region, there is a liability that the sheet adhesion and the toner image transfer occur due to the re-melting of the toner even in the case when the total amount of the toner over the entirety of the sheet is relatively small.

Therefore, in the following embodiments, efficient cooling of the toner image is realized by controlling the air blowing amount of the cooling fan 20 on the basis of the information of the toner image density acquired by the toner image density detecting portion 203.

Embodiment 1

Figure 4:
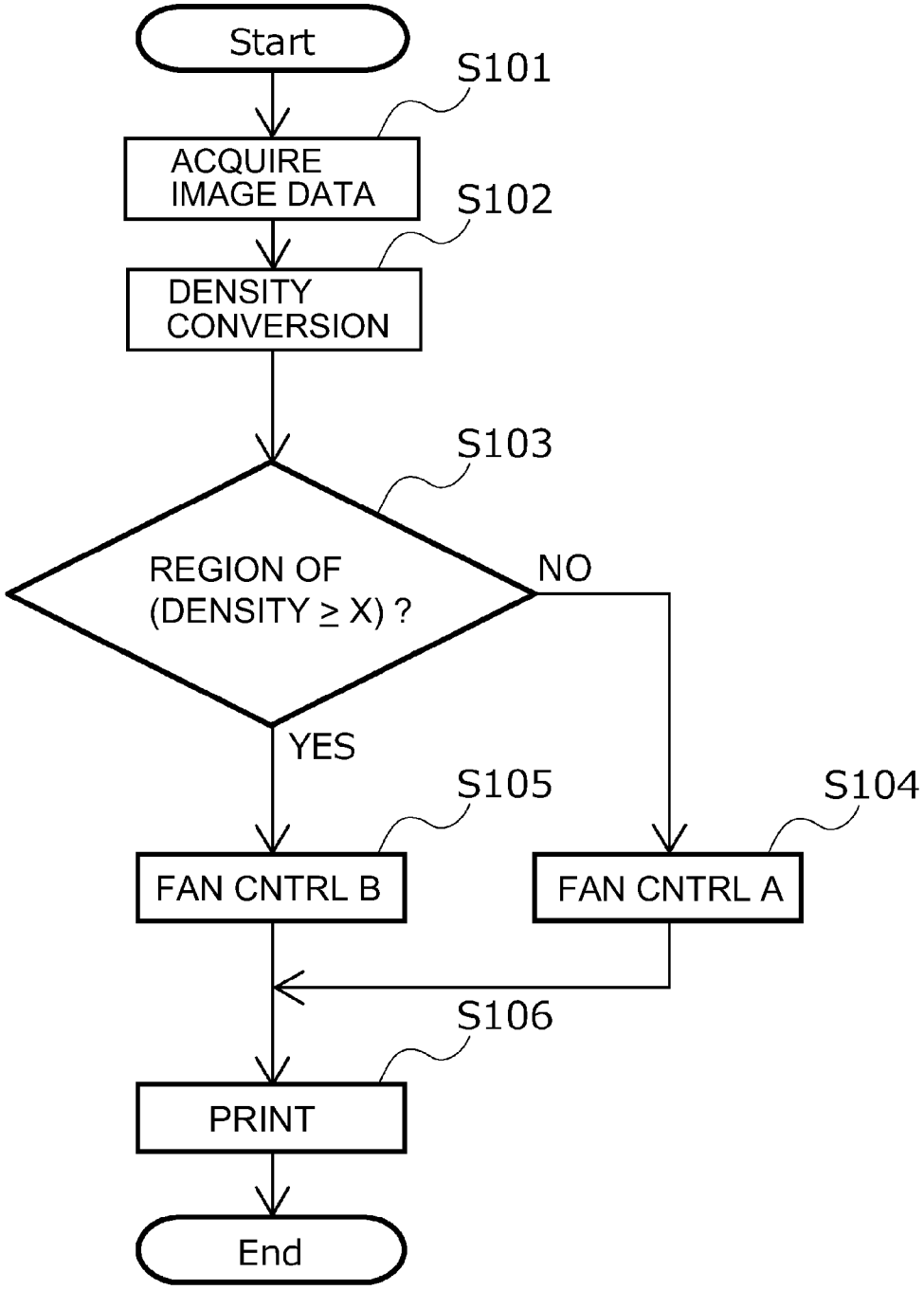
FIG. 4 is a flowchart showing a method of controlling the cooling fan according to Embodiment 1.

First, a method of controlling a cooling fan 20 according to First Embodiment (Embodiment 1) will be described using a flowchart of FIG. 4. FIG. 4 represents the method of controlling the cooling fan 20 in an operation from a start of the image forming operation until discharge of the sheet S is completed. Inclusive of embodiments described later, respective steps of flowcharts are realized by execution of control programs by the CPU 201 of the controller 200 in cooperation with respective functional portions such as the toner image density detecting portion 203 and the cooling fan controller 204.

The image forming operation is started in the case when a signal (image forming job) for providing an instruction to execute image formation from the external device is received or in the case when an operation (for example pressing-down of a copy button) is performed at an operating portion provided on the image forming apparatus 100. The controller 200 acquires image information of the image to be printed (S101) and converts the image information into image data for causing the image forming portion 102 to form the image. Then, from this image data, a toner image density in each unit area (for example in a region of 1 inch×1 inch) constituting an image region is calculatedly by the unit area detecting portion 203A (S102). Hereafter the toner image density in each unit region calculated in S102 is referred to as a "toner image density per unit area". Further, of a plurality of unit area regions constituting an entirety of the region (effective printing region) in which the image can be formed on the sheet, a largest toner image density per unit area is detected.

Then, depending on a comparison result of the largest toner image density per unit area with a threshold X of the toner image density set in advance, an operation mode of the cooling fan 20 is determined (S103). At this time, in the case when the largest toner image density per unit area is smaller than the threshold X, the operation mode of "FAN control A" is selected (S104), and in the case when the largest toner image density per unit area is not less than the threshold X, the operation mode of "FAN control B" is selected (S105). Then, as a printing step, a feeding process of the sheet S and an image forming process are executed, so that an image is formed on the sheet S (S106), and then the sheet S is discharged in a state in which the cooling fan 20 blows the air in the selected operation mode.

Air blowing amounts in the respective operation modes are set to satisfy a relationship of (FAN control A)<(FAN control B), i.e., are set so that cooling power of the FAN control B is higher than cooling power of the FAN cooling A. Further, in the case when images are formed on a plurality of sheets, the operation mode of the cooling fan 20 is determined sheet by sheet depending on the image formed on the associated sheet. That is, the cooling fan 20 is drive-controlled so that the cooling fan 20 is in a driving state set for each of the operation modes before the associated sheet reaches a position of the cooling fan 20 at the latest.

Further, the threshold X of the toner image density is set at, for example, X=100 in the case when the toner deposition amount at each pixel is controllable at 200 levels. In this case, with respect to an objective unit region, when the toner image is formed with a density of "100" uniformly at all the pixels in the region, a determination that the toner image density in this region is not less than the threshold is made. Further, even in the case when the toner image is formed only at a part of the unit region, when a total of the toner amounts in the region is not less than a toner amount in the case when the toner image is formed with the density of "100" uniformly at all the pixels in the region, a determination that the toner image density in this region is not less than the threshold is made.

As shown in part (a) of FIG. 8, in the case when a partial image with a maximum density (solid image) capable of being outputted by the image forming portion 102 is formed over a certain area and a remaining portion is a white background, a high-density toner image is formed at least in some of the unit regions (regions defined by broken lines). Accordingly, a determination that a high-density region where the toner image density is not less than the threshold X exists is made (S103: YES), so that as the operation mode of the cooling fan 20, the "FAN control B" in which the air blowing amount is large is selected. Further, as another image example, even in the case when the image is divided into a plurality of image portions as shown in part (b) of FIG. 8, the high-density toner image is formed at least in illustrated solid black unit regions. In such a case, a determination that the high-density region where the toner image density is not less than the threshold X exists is made (S103: YES), so that the "FAN control B" is selected.

On the other hand, as shown in part (c) of FIG. 8, in the case when a low-density image is formed so that the toner image density is less than the threshold X in all the unit regions, the region where the toner image density is not less than the threshold X does not exist (S103: NO). Accordingly, in such a case, the "FAN control A" in which the air blowing amount is small is selected.

Effect of Embodiment 1

As described above, in this embodiment, the air blowing amount is increased (and thus the cooling power is enhanced) in the case when an image with a locally high toner image density is formed based on a value of the largest toner image density per unit area. In this embodiment, the air blowing amount is decreased in other cases and cooling more than necessary is not carried. In other words, in the case when a first toner image (for example the image of part (c) of FIG. 8) in which a region which has an area not less than a predetermined area and which has a toner image density not less than a first density does not exist, the air blowing portion is operated in a first mode (FAN control A) in which the air blowing amount is small. On the other hand, in the case when a second toner image (for example the images of parts (a) and (b) of FIG. 8) in which the region which has the area not less than the predetermined area and which has the toner image density not less than the first density does not exist, the air blowing portion is operated in a second mode (FAN control B) in which the air blowing amount is larger than the air blowing amount in the first mode. At this time, irrespective of whether or not the toner amount of the second toner image over the entirety of the sheet is larger than the toner amount of the first toner image over the entirety of the sheet, when the second toner image is outputted, the air blowing portion is operated in the second mode.

Thus, by selecting the operation mode of the air blowing portion depending on whether or not the portion with the high toner image density locally exists in the toner image, an efficient air blowing operation by the air blowing portion can be realized. Specifically, in the case when the unit regions where the toner image density is high exist and thus a risk of an occurrence of the re-melting of the toner is high, the air blowing amount is set at a large value irrespective of the toner deposition amount on the entirety of the sheet, and therefore, it is possible to reduce the degrees of the occurrences of the sheet adhesion and the image transfer. Further, in the case when the unit regions where the toner image density is high do not exist and thus the risk of the occurrence of the re-melting of the toner is relatively low, the air blowing amount is set at a small value, so that an operation time and a rotational speed of the cooling fan 20 are suppressed and thus it becomes possible to reduce the noise and the electric power consumption.

A typical operation of the image forming apparatus 100 to which this embodiment is applied will be described using image examples of parts (e) to (j) of FIG. 8. Parts (e) and (0 of FIG. 8 represent half-tone images each formed in an entirety of the effective printing region, in which part (e) corresponds to the case when the toner image density is not less than the threshold X, and part (0 corresponds to the case when the toner image density is less than the threshold X. When the image of part (e) is outputted, the cooling fan 20 is in a state in which the air blowing amount thereof is large, and when the image of part (0 is outputted, the cooling fan 20 is in a state in which the air blowing amount thereof is small. Here, when the density of the half-tone image is changed, the air blowing amount of the cooling fan 20 is changed with a certain threshold as a boundary. At this time, in the case when a partial solid (black) image (part (g) of FIG. 8) equal in total amount of the toner to the half-tone image with the sheet density is outputted, according to this embodiment, discrimination that the toner image density in the unit regions positioned at the solid image portion is high is made, so that the cooling fan 20 is in a state in which the air blowing amount thereof is large. As a result, at a central portion of the image of part (g) of FIG. 8 which is a region in which the toner image density is high (thick), the occurrence of the re-melting of the toner can be prevented.

Part (h) of FIG. 8 represents a solid (black) image formed with a certain area at a central portion of the effective printing region. When this image is outputted, the toner image density in the unit regions positioned at least at the central portion is high, so that the cooling fan 20 is in a state in which the air blowing amount thereof is large. In this case, a series of images prepared by dividing the effective printing region into equal area regions so that a ratio of the toner image in each of the divided regions is equal to the ratio of the toner image in the effective printing region of the original image (part (h) of FIG. 8). Part (i) of FIG. 8 shows the case of 16 divided regions, and part (j) shows the case of 256 divided regions. In the case when such images are successively outputted, with an increasing number of the divided regions, the toner image density per unit region is averaged. Accordingly, according to this embodiment, in the original image (part (h) of FIG. 8), when the total amount of the toner to an entirety of the effective printing region is less than the threshold X, in the case when the number of the divided regions is increased to a certain value or more, the state of the cooling fan 20 is switched to a state in which the air blowing amount of the cooling fan 20 is small. That is, individual regions where the toner image density is high are decreased, so that the risk of the occurrence of the re-melting of the toner becomes small, and therefore, in such a case, the air blowing amount of the cooling fan 20 is suppressed.

Modified Embodiment

In the above-described embodiment, a single threshold of the toner image density is set in advance and the operation of the cooling fan 20 is changed depending on whether or not the region in which the toner image density per unit area exceeds this threshold exists. When the operation of the air blowing portion is appropriately changed depending on information of the local toner image density, a plurality of thresholds may also be set as shown in FIG. 5, for example.

Figure 5:
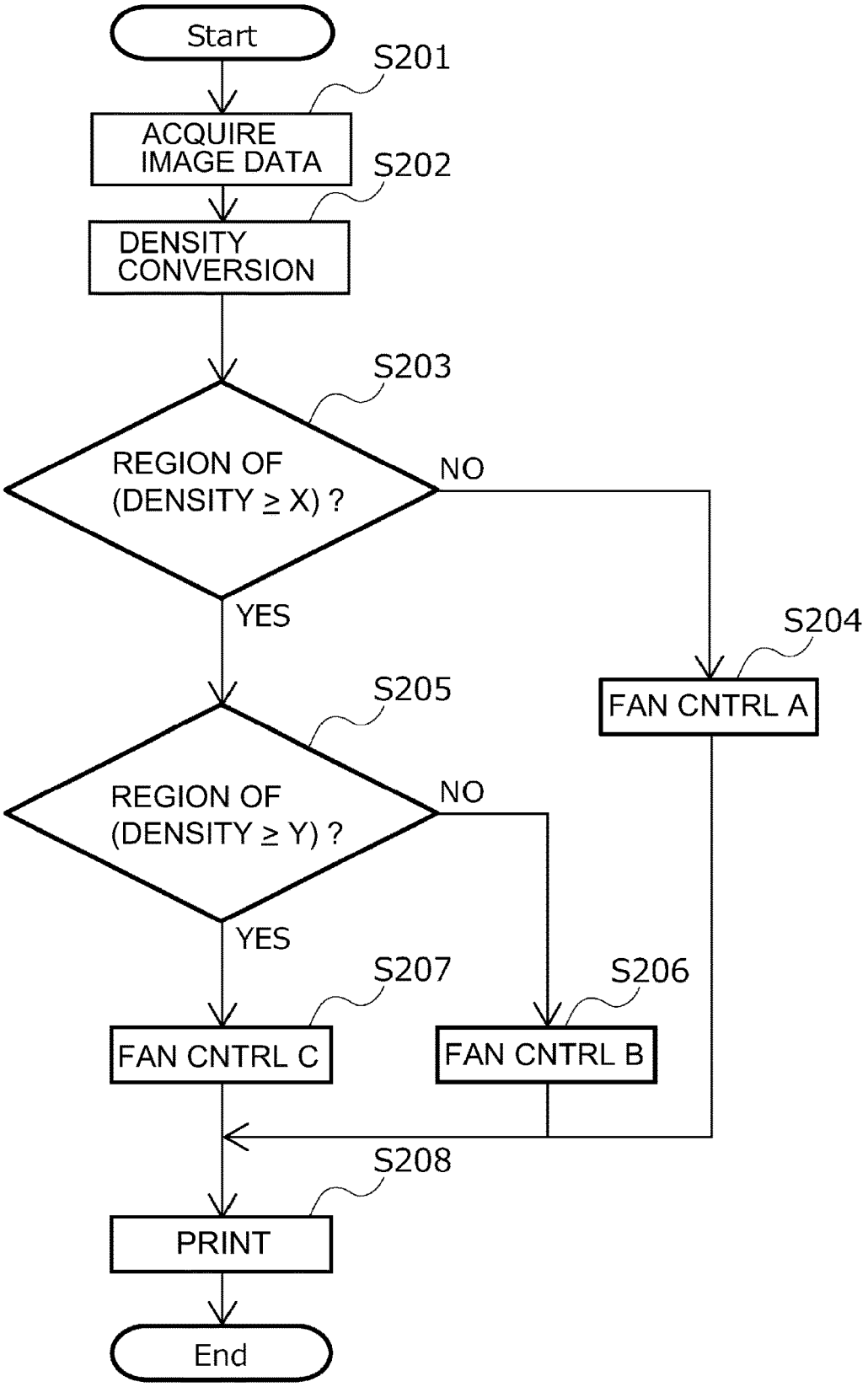
FIG. 5 is a flowchart showing a method of controlling a cooling fan according to a modified embodiment of Embodiment 1.

In the modified embodiment of FIG. 5, separately from the above-described threshold X, a threshold Y of the toner image density higher than the threshold X is provided, so that the operation mode of the cooling fan 20 is divided into three modes. When the image forming operation is started, the cooling fan 200 acquires image information of the image to be printed (S201) and converts the image information into image data for causing the image forming portion 102 to form the image. From this image data, a toner image density per unit area in each unit area is calculated by the unit area detecting portion 203A (S202). Further, of the plurality of unit regions constituting the effective printing region, a largest toner image density per unit area is detected.

Then, depending on a comparison result of the largest toner image density per unit area with thresholds X and Y of the toner image density set in advance, operation modes of the cooling fan 20 are determined (S203 and S205). At this time, when the largest toner image density per unit area is smaller than the threshold X (first density), the "FAN control A" corresponding to a first mode is selected (S204). When the largest toner image density per unit area is not less than the threshold X and less than the threshold Y (second density), the "FAN control B" corresponding to a second mode is selected (S206). Further, when the largest toner image density per unit area is not less than the threshold Y, "FAN control C" corresponding to a third mode is selected (S207). Then, as a printing step, a feeding process of the sheet S and an image forming process are executed, so that an image is formed on the sheet S (S208), and then the sheet S is discharged in a state in which the cooling fan 20 blows the air in the selected operation mode.

Air blowing amounts in the respective operation modes are set to satisfy a relationship of (FAN control A)<(FAN control B)<(FAN control C).

(S103). Thus, by providing the plurality of the thresholds of the toner image density, the air blowing amount of the cooling fan 20 can be changed at three levels or more. As a result, it becomes possible to carry out further fine control so as to avoid the re-melting of the toner while suppressing the noise and the electric power consumption with the air blowing by the cooling fan 20 to a minimum level.

Another Modified Embodiment

In Embodiment 1, the entirety of the region in which the toner image is capable of being formed by the image forming portion 102 is divided into unit regions each one-inch square in advance, and the air blowing amount is controlled on the basis of the toner image density in each of the unit regions. The area and a shape of each of the unit regions can be appropriately changed as long as a degree of the re-melting of the toner can be sufficiently reduced depending on a constitution of the image forming apparatus 100 (for example, depending on a melting point (temperature) of the toner or temperature setting of the fixing device 150). As the area of the unit region, for example 1 $cm^2$ to 10 $cm^2$ are suitable. Incidentally, in the case when the unit region is excessively broad, there is a possibility that the re-melting of the toner occurs by localization of the toner image density in the region, and in the case when the unit region is excessively narrow (for example, in the case when the unit region is nearly equal to the pixel (size)), there is a possibility that ease of the re-melting of the toner cannot be properly evaluated.

Further, in Embodiment 1, the presence or absence of the region where the toner image density is high is discriminated by calculating the toner image density for each of the unit regions defined (divided) in advance, but it is also possible to determine the region where the toner image density is high, by another processing method. For example, as regards lattice points equidistantly provided in the effective printing region, an average of movement of the toner amount at pixels around each of the lattice points is acquired and then may also be compared with the toner image density which is the threshold. Further, image data in which each of the pixels is binarized is prepared depending on whether or not the toner amount at each pixel is not less than the threshold, and then whether or not an area of the region constituted by a group of pixels of the threshold or more is not less than a predetermined area may also be discriminated.

Embodiment 2

Figure 6:
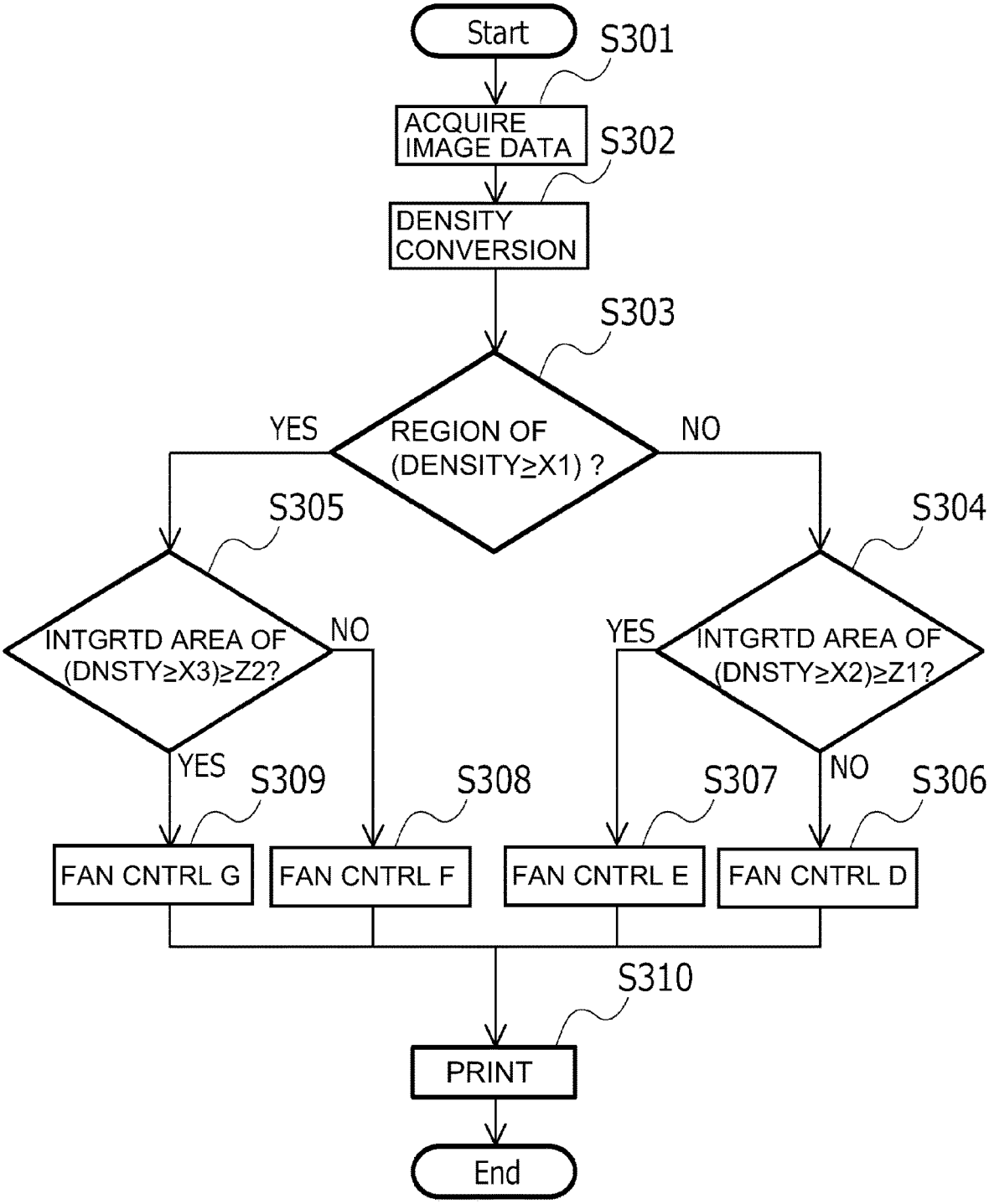
FIG. 6 is a flowchart showing a method of controlling a cooling fan according to Embodiment 2.
Figure 7:
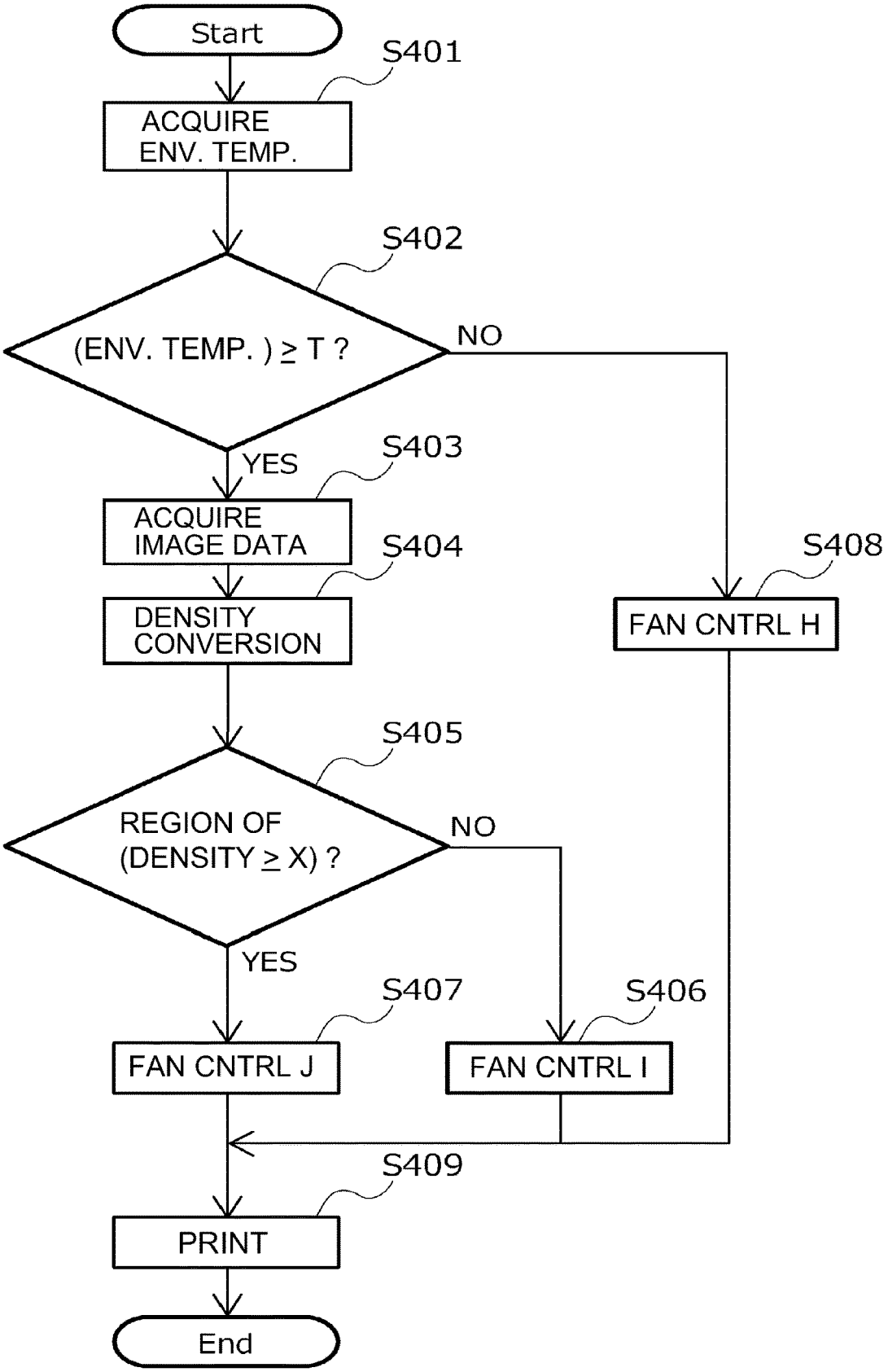
FIG. 7 is a flowchart showing a method of controlling a cooling fan according to Embodiment 3.

Next, a method of controlling a cooling fan 20 according to Second Embodiment (Embodiment 2) will be described using a flowchart of FIG. 6. This embodiment is different from Embodiment 1 in that the air blowing amount of the cooling fan 20 is changed depending on not only the presence or absence of the region where the toner image density is high but also an integrated area of the region. Other elements similar to those in Embodiment 1 are represented by the same reference numerals or symbols and will be omitted from description.

When the image forming operation is started, the cooling fan 200 acquires image information of the image to be printed (S301) and converts the image information into image data for causing the image forming portion 102 to form the image. From resultant image data, a toner image density per unit area in each unit area is calculated by the unit area detecting portion 203A (S302). Further, of the unit regions constituting the effective printing region, a largest toner image density per unit area is detected.

Then, depending on the largest toner image density per unit area and a total area of the regions where the toner image density per unit area is not less than a predetermined value, operation modes of the cooling fan 20 are determined (S303, S304 and S305). In the case when the largest toner image density per unit area is less than a threshold X1 set in advance (S303: NO), an integrated area of regions where the toner image density per unit area is not less than a threshold X2 is compared with a threshold area Z1. In the case when the integrated area is less than the threshold area Z1, "FAN control D" is selected (S306), and in the case when the integrated area is not less than the threshold area Z1, "FAN control E" is selected (S307). The air blowing amounts of the respective operation modes are set so as to satisfy a relationship of (FAN control D)<(FAN control E).

On the other hand, in the case when the largest toner image density per unit area is not less than a threshold X1 set in advance (S303: YES), an integrated area of regions where the toner image density per unit area is not less than a threshold X3 is compared with a threshold area Z2. In the case when the integrated area is less than the threshold area Z1, "FAN control F" is selected (S308), and in the case when the integrated area is not less than the threshold area Z1, "FAN control G" is selected (S309). The air blowing amounts of the respective operation modes are set so as to satisfy a relationship of (FAN control F)<(FAN control G).

Thereafter, as a printing step, a feeding process of the sheet S and an image forming process are executed (S310), and in a state in which the cooling fan 20 blows air in the selected operation mode, an image is formed on the sheet S and then the sheet S is discharged.

As regards the thresholds X1, X2 and X3, these values can be appropriately changed depending on a constitution of the image forming apparatus 100, but are set so as to satisfy a relationship of X1=X3 >X2, for example. Further, the above-described threshold areas Z1 and Z2 are values equal to each other, but can be appropriately changed.

Effect of Embodiment 2

As described above, also in this embodiment, on the basis of the information of the local toner image density, a first mode (FAN control D and FAN control F) and a second mode (FAN control E and FAN control G) are switched. Accordingly, similarly as in Embodiment 1, it becomes possible to avoid the re-melting of the toner while suppressing the noise and the electric power consumption with the air blowing by the cooling fan 20 to a minimum level.

Further, in this embodiment, in each of the cases when the region where the toner image density is not less than the threshold X1 exists and does not exist, the air blowing amount is switched depending on the integrated area of the regions where the toner image density is not less than the threshold X2 or X3 (S304, S305). Further, for example, as shown in parts (a), (b) and (d) of FIG. 8, the air blowing amounts in the cases when the integrated areas of the high-density regions are large (parts (a) and (b) of FIG. 8) are set so as to be larger than the air blowing amount in the case when the integrated area of the high-density regions is small (part 8*d*) of FIG. 8).

Here, the temperature of a sheet bundle stacked on the discharge tray 170 is high and thus the re-melting of the toner is liable to occur in the case when a region where the toner image density is high is large. In this embodiment, the air blowing amount is set at a larger value in the case when the integrated area of regions where the toner image density is relatively high is broad so as to be not less than predetermined threshold areas Z2 and Z3, and therefore, the re-melting of the toner can be avoided further reliably. Further, even in the case when the high-density regions exist, when the integrated area of the regions is small and the re-melting of the toner does not readily occur, the air blowing amount is set at a smaller value, and therefore, contributes to suppression of the noise and the electric power consumption with the air blowing by the cooling fan 20 to a minimum level.

Embodiment 3

Next, a method of controlling a cooling fan 20 according to Third Embodiment (Embodiment 3) will be described using a flowchart of FIG. 6. This embodiment is different from Embodiment 1 in that the air blowing amount of the cooling fan 20 is changed depending on not only the presence or absence of the region where the toner image density is high but also an environmental temperature, i.e., a temperature of a space in which the image forming apparatus 100 is installed. Other elements similar to those in Embodiment 1 are represented by the same reference numerals or symbols and will be omitted from description.

When the image forming operation is started, the controller 200 acquires a value of an environmental temperature from a detection signal of an environment sensor 30 (FIG. 1) as a temperature detecting portion (S401), and compares the acquired value with a temperature threshold T set in advance (S402). In the case when the acquired value of the environmental temperature is less than the temperature threshold T, "FAN control H" is selected as the operation mode of the cooling fan 20. In the case when the value of the environmental temperature acquired in S401 is not less than the temperature threshold T, "FAN control I" or "FAN control J" is selected as the operation mode of the cooling fan 20 by procedures (S403 to S407) similar to S101 to S105 of Embodiment 1.

Thereafter, as a printing step, a feeding process of the sheet S and an image forming process are executed (S409), and in a state in which the cooling fan 20 blows air in the selected operation mode, an image is formed on the sheet S and then the sheet S is discharged. The air blowing amounts in the respective operation modes are set so as to satisfy a relationship (FAN control H)<(FAN control I)<(FAN control J).

Effect of Embodiment 3

As described above, also in this embodiment, on the basis of the information of the local toner image density, a first mode (FAN control I) and a second mode (FAN control J) are switched. Accordingly, similarly as in Embodiment 1, it becomes possible to avoid the re-melting of the toner while suppressing the noise and the electric power consumption with the air blowing by the cooling fan 20 to a minimum level.

Further, in this embodiment, a constitution in which the air blowing amount is increased or decreased depending on the environmental temperature detected by the environment sensor 30 is employed. In general, it has been known that a temperature of the sheet bundle stacked on the discharge tray 170 is higher with an increasing environmental temperature and thus the re-melting of the toner is liable to occur. According to this embodiment, in the case when the environmental temperature is lower than a predetermined temperature (T) and the re-melting of the toner does not readily occur, the air blowing amount of the cooling fan 20 is set so as to be small compared with the case when the environmental temperature is not less than the predetermined temperature. For this reason, this setting contributes to suppression of the noise and the electric power consumption with the air blowing by the cooling fan 20 to a minimum level.

Modified Embodiment

In this embodiment, description was made on the assumption that the air blowing amount of the cooling fan 20 is constant when the environmental temperature is less than the predetermined temperature, but even when the environmental temperature is less than the predetermined temperature, the air blowing amount of the cooling fan 20 may also be made changeable. For example, for each of temperature zones set in advance, the air blowing amount in a mode (first mode) in which the air blowing amount is relatively small or in a mode (second mode) in which the air blowing amount is relatively large is set, and then the air blowing amount of the cooling fan 20 may also be determined on the basis of the temperature zone to which a detection result of the environmental temperature pertains and on the basis of the information of the toner image density.

Other Embodiments

The present invention is not limited to Embodiments 1 to 3 described above, but may also employ the following alternative constitutions, for example. A constitution in which as the cooling portion, in place of the cooling fan 20 blowing the air on the sheet, a metal roller or guide contacting the sheet is provided as a heat sink and in which cooling power of the heat sink is controlled by air blown by a fan or by circulation of a cooling medium may also be employed. Further, the position where the cooling portion is provided is not limited to those shown in FIGS. 1 and 2. For example, in an image forming apparatus where a sheet processing apparatus is connected to the apparatus main assembly 101, the cooling portion may also be disposed at a position where the sheet discharged toward the sheet processing apparatus can be cooled. The sheet processing apparatus may be, for example, an apparatus that subjects the sheets, on which the images are formed, to a binding process.

Further, the operation mode of the cooling fan may also be switched by combining the conditions described in Embodiments 1 to 3 with other conditions, such as execution or non-execution of the double-side printing, temperature setting of the fixing device 150 depending on a material of the sheet, a process speed of the sheet and a humidity. In such a constitution, the first mode and the second mode refer to, of operation states of the cooling fan 20 in the case when conditions other than the distribution of the toner image density are equal to each other, the case when the air blowing amount of the cooling fan 20 is relatively small (first mode) and the case when the air blowing amount of the cooling fan 20 is relatively large (second mode).

The present invention can also be realized in a process in which a program for realizing one or more functions of the above-described embodiments is supplied to a system or an apparatus through network or a storing medium and then is read and executed by one or more processors in a computer of the system or the apparatus. Further, the present invention can also be realized by a circuit (for example, ASIC) for realizing one or more functions.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus comprising:

an image forming portion configured to form a toner image on a sheet;

a heating portion configured to heat the toner image formed by said image forming portion as the sheet is passed through said heating portion;

a discharging portion configured to discharge the sheet passed through said heating portion;

a cooling portion configured to cool the sheet heated by said heating portion;

an acquiring portion configured to acquire information on the toner image formed on the sheet; and a controller capable of causing said cooling portion to operate in any one of a plurality of modes, the plurality of modes including a first mode and a second mode that is higher in cooling power than the first mode, the controller being configured to control said cooling portion on the basis of the information acquired by said acquiring portion such that, (i) when a first toner image is formed on the sheet, said controller operates said cooling portion in the first mode, in the first toner image, a region where a toner image density having a predetermined first density or more is absent, and (ii) when a second toner image, in which the region is present, is formed on the sheet, said controller operates said cooling portion in the second mode irrespective of a toner amount of the second toner image over the entirety of the sheet, wherein the toner image density is a toner amount per predetermined sheet area of the toner image formed on the sheet by said image forming portion.

2. The image forming apparatus according to claim 1, wherein the entirety of a region in which said image forming portion is capable of forming the toner image on the sheet is constituted by a plurality of unit regions each having a predetermined sheet area, and wherein said acquiring portion acquires information on the toner image density in each of the unit regions from image data corresponding to the toner image to be formed on the sheet by said image forming portion, and said controller is configured to execute the operation in the first mode when said controller determines that the toner image density in each of the unit regions of all the unit regions is lower than the first density and executes the operation in the second mode when the controller discriminates that the toner image density in any one of the unit regions is the first density or more.

3. The image forming apparatus according to claim 1, wherein the plurality of modes includes a third mode that is higher in cooling power than the second mode, and wherein, in a case when the toner image to be formed on the sheet by said image forming portion includes the region where the toner image density is the first density or more, said controller operates said cooling portion in the third mode when a region where the toner image density having a second density that is higher than the first density is present and operates said cooling portion in the second mode when the region where the toner image density having the second density or more is absent.

4. The image forming apparatus according to claim 1, wherein, in a case when the region, where the toner image density is the first density or more is present in the toner image to be formed on the sheet by the image forming apparatus, said controller is configured to change the cooling power of said cooling portion depending on an area of each region of all of the regions where the toner image density is the first density or more.

5. The image forming apparatus according to claim 1, further comprising a temperature detecting portion configured to detect a temperature, wherein when the temperature detected by said temperature detecting portion is a predetermined temperature or more, said controller is configured to cause said cooling portion to operate in the first mode or the second mode, depending on whether or not the region where the toner image density is the first density is present, and wherein, when the temperature detected by said detecting portion is less than the predetermined temperature, said controller is configured to cause said cooling portion to operate in a mode lower in cooling power than the first mode.

6. The image forming apparatus according to claim 1, wherein said cooling portion is a fan for blowing air on the sheet passed through said heating portion, the fan blowing air in an air blowing amount, and wherein the air blowing amount in the first mode is set at a value that is less than an air blowing amount in the second mode.

7. The image forming apparatus according to claim 1, wherein, in a case when toner images are formed on a plurality of sheets by said image forming portion, said controller determines, depending on the toner image formed on each of the sheets, an operation mode of said cooling portion when each of the sheets is discharged by said discharging portion.

8. The image forming apparatus according to claim 1, further comprising a stacking portion configured to stack the sheets discharged by said discharging portion, wherein said cooling portion cools the sheet in a sheet feeding path between said heating portion and said discharging portion.

9. An image forming apparatus comprising:

an image forming portion configured to form a toner image on a sheet;

a heating portion configured to heat the toner image formed by said image forming portion as the sheet is passed through said heating portion;

a discharging portion configured to discharge the sheet passed through said heating portion;

a cooling portion configured to cool the sheet heated by said heating portion;

an acquiring portion configured to acquire information on the toner image formed on the sheet; and a controller configured to control said cooling portion on the basis of the information acquired by said acquiring portion, wherein said controller is configured to control said cooling portion in a first mode when a first sheet on which a first toner image is formed, is cooled by said cooling portion, and to control said cooling portion in a second mode that is greater in cooling power than the first mode when a second sheet, on which a second toner image is formed, is cooled by said cooling portion, wherein an entire toner amount of the first toner image is more than an entire toner amount of the second toner image, wherein, in the first toner image, a region where the toner image density having a first density or more is absent, and wherein, in the second toner image, a region where the toner image density having the first density or more is present.

10. The image forming apparatus according to claim 9, further comprising a fan, wherein a rotational speed of said fan in the second mode is higher than a rotational speed of said fan in the first mode.

* * * * *